United States Patent [19]

Lane

[11] 4,053,150

[45] Oct. 11, 1977

[54] FOLDER APPARATUS

[75] Inventor: Leslie A. Lane, Indianapolis, Ind.

[73] Assignee: Cornelius Printing Co., Indianapolis, Ind.

[21] Appl. No.: 664,622

[22] Filed: Mar. 8, 1976

[51] Int. Cl.[2] ..... B65H 45/18

[52] U.S. Cl. ..... 270/67; 270/69

[58] Field of Search ..... 270/69, 67, 80–85; 93/32, 84 R, 8 FF

[56] References Cited

U.S. PATENT DOCUMENTS 3,790,157 2/1974 Crawford ..... 270/69

FOREIGN PATENT DOCUMENTS 709,804 6/1954 United Kingdom ..... 270/69

*Primary Examiner*—Edgar S. Burr
*Assistant Examiner*—A. Heinz
*Attorney, Agent, or Firm*—Woodard, Weikart, Emhardt & Naughton

[57] ABSTRACT

The folding blade or knife of a quarter folder apparatus for paper such as newsprint includes a pair of air jets, one on each side of the top portion of the blade, directed toward the paper being folded. The air jets are supplied from a compressed air source through a flexible tubing. The air jets maintain the ends of the pages being folded in a flattened and aligned configuration throughout the folding operation, thereby preventing wrinkled and dog-eared pages in the folded paper.

5 Claims, 4 Drawing Figures

FOLDER APPARATUS

BACKGROUND OF THE INVENTION

1. Field of the Invention

This invention is in the field of blade folders.

2. Description of the Prior Art

Compressed air has been utilized in various folding apparatus in the past, such as is shown in several prior art patents disclosing the use of compressed air jets to force a central portion of a sheet of material between a pair of pinch rollers for effecting a fold. Essentially, these devices have utilized the compressed air instead of a folding blade or knife as is used for folding in the presently described embodiment.

U.S. Pat. No. 3,506,255 to Jahn et al shows the use of air flow for both page flattening and page lifting in a cross-fold rotary machine. The folding operation is different from that in the presently disclosed quarter folder apparatus and additionally the nozzles are mounted away from the folding blade either on the machine frame itself or on a "blank holder". The air jets of Jahn et al are not maintaining the alignment and flatness of a group of pages having free ends nor is the action of the sheet being folded of the same type as in a quarter folder apparatus wherein proper maintanence of the page array is critical to avoid undersired folding and dog-eared edges.

SUMMARY OF THE INVENTION

In operating a quarter folder for paper such as newsprint, it has been found that an undesirably high degree of folded and dog-eared edges of the pages have been obtained. For example, a multipage tabloid newspaper arrives at the quarter folder in its configuration such as the paper would be in for reading with the half fold having already been provided. This leaves the folded edges at, for example, the left, and the free ends of the pages at the right. The quarter folder now executes another fold half way between the top and the bottom of the tabloid newspaper, the blade of the quarter folder forcing the center of the paper through a slot where it is engaged by a pair of pinch rollers and pulled through the slot, folded, and deposited on a receiving conveyor or other means below. This additional fold is often required, for example, for preparing the paper for mailing.

When such mailings are made, often an automatic addressing machine is utilized to place subscribers' addresses on the paper, and this name and address is administered to the papers at one of the corners of an outside free-edge of the paper. Unfortunately, this is precisely a page edge which most often becomes dog-eared or erroneously folded in the quarter folding operation. Applicant had previously unsuccessfully utilized various angles and patterns of air flow from frame-mounted nozzles at the quarter folding slot and nearby platform and failed to significantly decrease the number of poorly folded and dog-eared edges.

The mounting of air supply means on the folding blade assembly itself, as shown in the present embodiment, has significantly decreased the incidence of dog-eared pages of papers folded in the quarter folder. While in the past the only way to avoid the problem of dog-eared page edges was to operate the quarter folder at a lower rate of speed, now with the utilization of applicant's device, the speed of one quarter folder was increased from 21,000 folds per hour to 27,000 folds per hour with an actual decrease in the incidence of defective pages in folded papers from the folder.

One embodiment of the present invention is a folder apparatus having a movable folding blade and a platform defining a blade-receiving slot generally aligned with the path of said blade, the improvement which comprises the folding blade including air flow means receiving compressed air at an inlet for directing a flow of air adjacent the blade and in the direction of the slot and adjacent platform surface when the blade is moved near the slot and coupling means for coupling compressed air to the inlet of the air flow means.

It is an object of the present invention to provide an improvement to folding apparatus utilizing a folding knife or blade which prevents irregular turning or folding of the edges of sheets of material being folded in the device.

Further objects and advantages of the present invention shall be apparent from the following detailed description and accompanying figures.

DESCRIPTION OF THE PREFERRED EMBODIMENT

Figure 1:
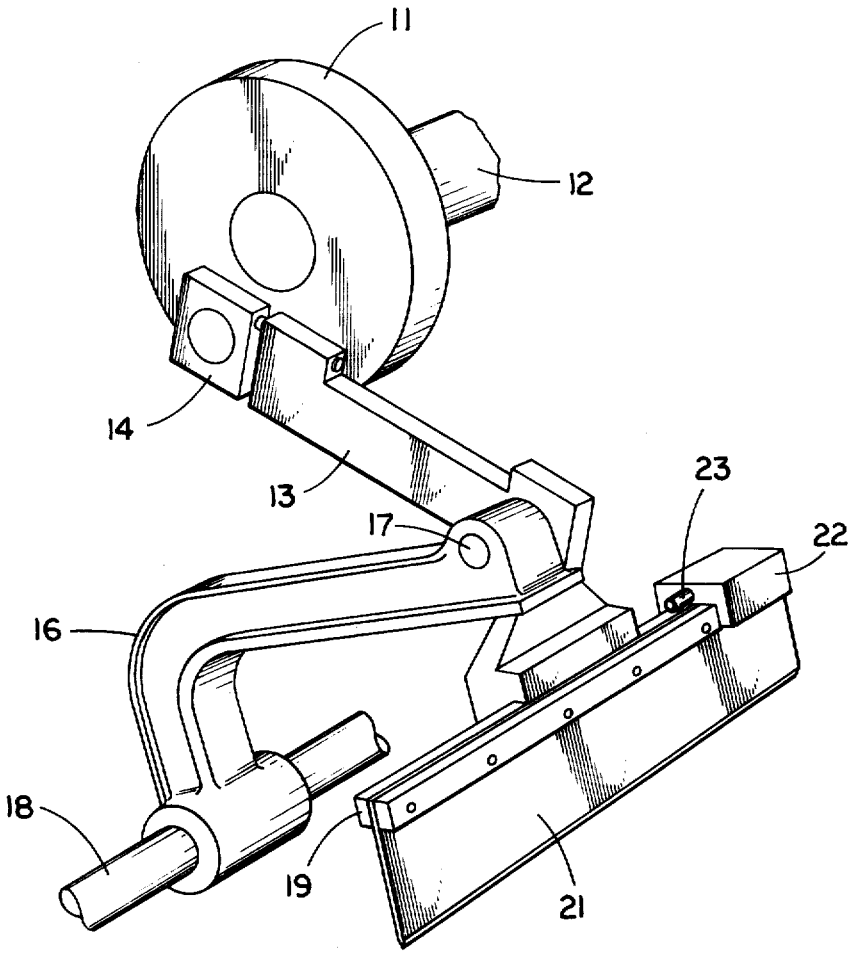
FIG. 1 is a perspective view of a portion of a quarter folder apparatus including the folding blade assembly and air jets.

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to FIG. 1, there is shown a portion of the folding blade reciprocating apparatus of a quarter folder such as is manufactured by American Type Founders of Whitinsville, Mass. As shown in FIG. 1, a driving cam 11 is driven by a drive shaft 12 which is coupled from the motor (not shown) associated with the quarter folder apparatus. An adjustable driving arm 13 is adjustably fixed within an adjustment block 14 which is attached to the driving cam as shown. The length of adjustable driving arm 13 determines the length of travel of the folding blade of the apparatus. A folding blade arm 16 is pivotally attached by pin 17 to adjustable driving arm 13 and is pivotally received at its other end on pivot bar 18, thus providing reciprocating motion of the folding blade.

Folding blade 21 is mounted in a blade holder block 19 which is rigidly attached to the folding blade arm 16. Rigidly mounted on folding blade holding member 19 is a compressed air manifold 22 receiving an air tube 23. Alternatively, the blade mounting block 19 and air flow manifold 22 may be of unitary construction.

Figure 2:
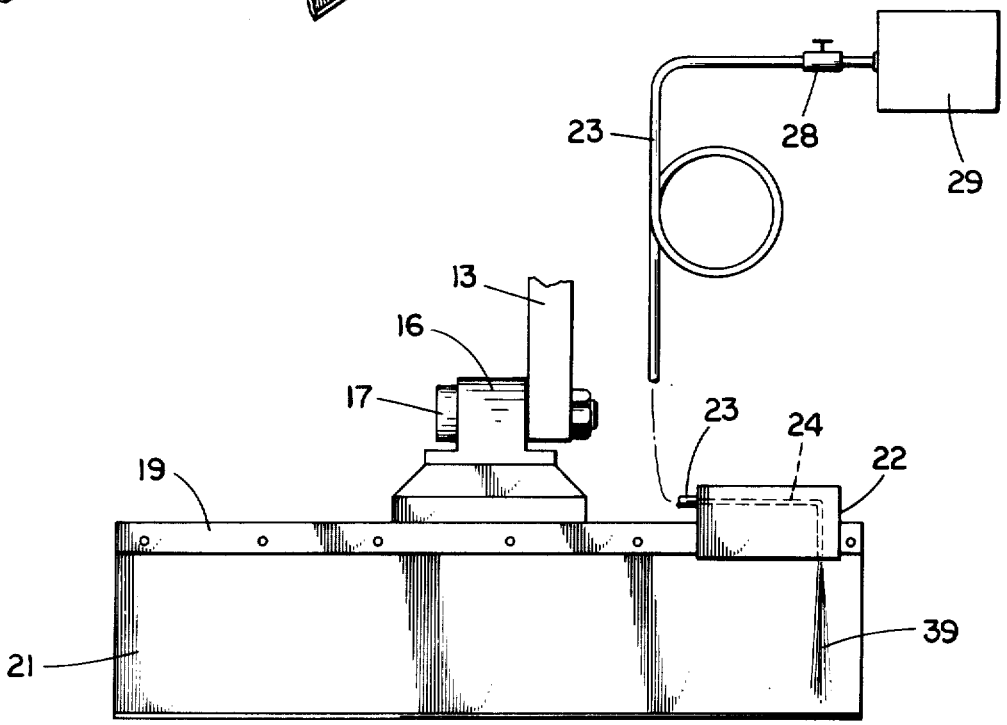
FIG. 2 is a front view of the embodiment of FIG. 1, additionally showing in diagrammatic form a connection to a source or compressed air.
Figure 3:
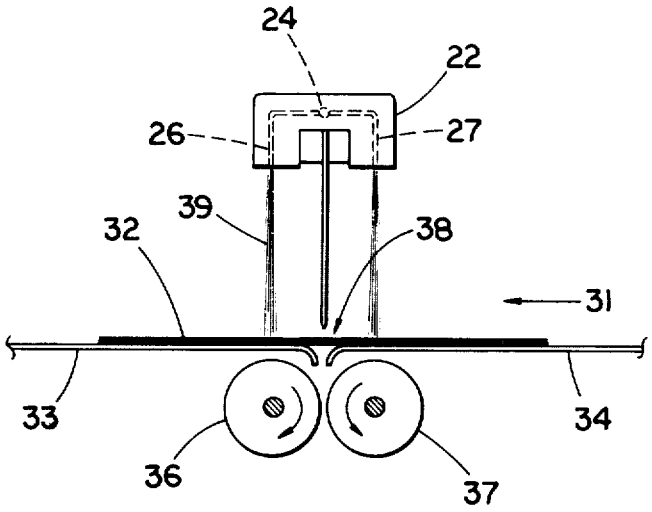
FIG. 3 is an end view of the blade assembly and air jets of FIG. 2 together with the platform and pinch roller portions of the folder.

As shown in FIG. 2, air tube 23 is coupled from a compressed air source 29 through a pressure adjustment valve 28. The appropriate air pressure to be used may be empirically determined dependent upon the thickness of the sheets to be folded, the sizes of the various air conduits and openings, etc. Inside manifold 22 an incoming air flow line 24 receives the air from flexible tube 23 and terminates in a pair of laterally (and then downwardly) extending smaller air channels 26 & 27 (FIG. 3). Each channel 26 and 27 extends laterally from center channel 24 and downwardly in the manifold on either side of blade 21 as shown in FIG. 3.

Also as shown in FIG. 3, a half folded multipaged newspaper 32 is moved in the direction of arrow 1 along a set of rollers or other platform onto a continuous quarter folder platform section defined by plates 33 and 34. As viewed in FIG. 3, the half fold of the newspaper is away from the viewer of the Figure and the free page ends of the newspaper are toward the viewer of the figure. In this orientation the air streams supplied through channels 26 and 27 are at the free page end of the folding blade.

A pair of folder wheels or pinch rollers 36 and 37 are provided beneath the platform defined by members 33 and 34 and are rotated in the direction shown. Above the nip of rollers 36 and 37, downwardly extending ledges on members 33 and 34 define an elongated slot 38 beneath the paper aligned with the path of travel of blade 21 as it is moved by driving arm 13 downwardly toward paper 32 and rollers 36 and 37.

Figure 4:
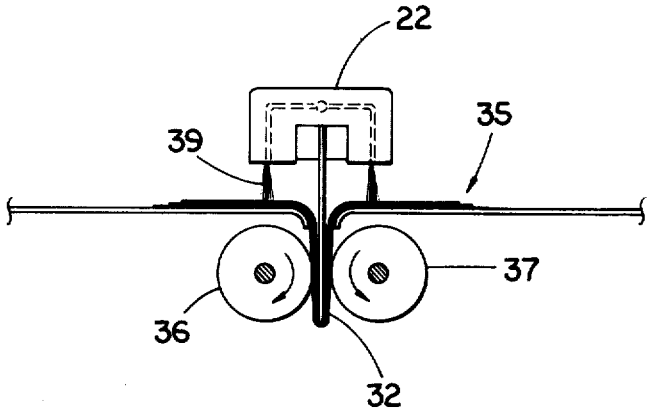
FIG. 4 is a showing similar to that of FIG. 3 with the folding blade partially down in the folding operation.

As shown in FIG. 4, as manifold 22 and blade 21 are moved downwardly by the driving mechanism toward and past slot 38, paper 32 is forced into a folded condition by the blade and received and driven downwardly by rollers 36 and 37. As shown in FIG. 4, loose pape ends such as 35 are maintained in a flattened condition by air flow jets such as 39 with the loose page ends being held along the contour defined by platform members 33 and 34 as the ends of the pages are driven toward the inclined ledges defining slot 38. The positive holding action of the air flow jets 39 prevents the bending, misfolding or dog-earing of the free page ends such as 35 which would normally occur due to the rapid rate of folding and cycling of blade 19.

After each paper 32 is drawn through slot 38 by the combined action of blade 19 and rollers 36 and 37, it is deposited on a receiving ledge or platform below, where the quarter folded papers may be removed to a subsequent location such as for automatic imprinting of names and addresses. In one embodiment of the present invention, a manifold was constructed in which inlet line 24 was of a one quarter inch diameter and the downwardly extending channels 26 and 27 had a diameter of one eighth of an inch. Air supply pressure for this system was at about 30 psi. As mentioned above, the appropriate air pressure may be selected depending upon the material of the sheets to be folded, and also the sizes of the channels within manifold 22 may be altered as required. The positive page edge-holding action obtained using air flow jets such as 39, as mentioned earlier, permits a more rapid operation and faster cycling of folding blade 19 and the folder mechanism. Utilizing the above-mentioned air channel dimensions and pressure, it was found that an American Type Founders quarter folder could be increased in speed from 21,000 per hour to 27,000 folds per hour with a decrease and virtual elimination of dog-eared page ends for folding of tabloid newspapers of, for example, 16 pages.

While there have been described above the principles of this invention in connection with specific apparatus, it is to be clearly understood that this description is made only by way of example and not as a limitation in the scope of the invention.

What is claimed is:

1. In a folder apparatus having a movable folding blade and having a platform including a surface and defining a blade-receiving slot generally aligned with the path of said blade, the blade having a folding edge positioned outwardly of the platform surface on one side of the platform when the blade is not received within the slot, the improvement which comprises:

the folding blade including air flow means receiving compressed air at an inlet for directing a flow of air at the platform surface adjacent the slot when the blade is moved near the slot;

the air flow means comprising a manifold member receiving compressed air at an inlet, the folding blade being elongated and having a first side and second side, the manifold member having a first portion extending beyond the first side of the folding blade and a second portion extending beyond the second side of the folding blade, each said manifold portion defining a passageway for air flow in communication with said inlet, each said passageway terminating in an opening in the manifold directed toward the folding edge of said folding blade, whereby a flow of air is directed adjacent each side of the blade in the direction of the slot and adjacent to the platform surface when the blade is moved near the slot.

2. The improvement of claim 1 in which the manifold member further defines a first passageway in communication with the inlet and extending within the manifold above the folding blade, said first passageway being in communication with the passages of the first and second portions of the manifold.

3. The improvement of claim 2 which further comprises a compressed air source, a pressure regulator coupled from the compressed air source, and a flexible tubing extending from the pressure regulator to the coupling means.

4. The improvement of claim 3 in which the folding apparatus is a quarter folder for paper such as newsprint.

5. The improvement of claim 4 in which said first passageway has a one quarter inch diameter and said lateral passages have a one eighth inch diameter, and the compressed air pressure supplied by the pressure regulator is 30 psi.

* * * * *